US005746688A

United States Patent [19]

Prager

[11] Patent Number: 5,746,688

[45] Date of Patent: May 5, 1998

[54] EXERCISE DEVICE

[76] Inventor: Howard A. Prager, 191 Hamburg Turnpike, Pompton Lakes, N.J. 07442

[21] Appl. No.: 855,383

[22] Filed: May 13, 1997

[51] Int. Cl.[6] ..... A63B 21/04

[52] U.S. Cl. ..... 482/142; 482/137; 482/140; 482/130

[58] Field of Search ..... 482/112, 111, 482/130, 140, 142, 148, 137

[56] References Cited

U.S. PATENT DOCUMENTS

| | | | |
|---|---|---|---|
| 2,264,046 | 12/1941 | McClettan | 482/140 |
| 4,556,216 | 12/1985 | Pitkanen | 482/137 |
| 5,419,750 | 5/1995 | Steinmetz | 482/112 |
| 5,435,801 | 7/1995 | Hung | 482/130 |
| 5,470,297 | 11/1995 | Park | 482/137 |
| 5,658,223 | 8/1997 | Habing et al. | 482/137 |

OTHER PUBLICATIONS

Nowtilus, the handbook for young athletes p. 44, 1984.

*Primary Examiner*—Jerome Donnelly
*Attorney, Agent, or Firm*—Richard T. Laughlin, Esq.; Graham, Curtin & Sheridan

[57] ABSTRACT

This invention relates to a portable exercise device for resistance type exercises of all muscles which make up the buttocks, including the gluteus maximus, gluteus minimis, gluteus medius and the piriformis muscles by both hip extension and hip abduction without undue stress on the spine and corresponding musculature. The device has a generally horizontal extending base, a headrest affixed to the base, a resistance bar for pressing against the underside of the thigh of the user which is pivotal to the base. Biasing means is provided for urging the resistance bar to a vertical position with a force which the user can overcome by moving the leg and thigh downward and for moving the resistance bar to a horizontal position. Biasing means is also provided for exerting a force to resist outward movement.

15 Claims, 2 Drawing Sheets

EXERCISE DEVICE

FIELD OF THE INVENTION

The invention generally relates to a portable exercise device for resistance type exercises of all muscles which make up the buttocks, including the gluteus maximus, gluteus minimis, gluteus medius and the piriformis muscles by both hip extension and hip abduction without undue stress on the lumbar and cervical spine.

BACKGROUND OF THE INVENTION

In recent years the value of staying trim and fit through the use of exercise mechanisms has become well recognized. This desire by both men and women for physical fitness has resulted in the availability of members-only health clubs which typically provide a variety of exercise machines whereupon one or two specific exercises are performed on each machine to exercise specific muscles.

One of the very early and popular series of machines of this type is sold under the trademark NAUTILUS®. These exercise machines, as is well known to those skilled in the art, permit exercising of a desired muscle group against a progressively resistant force which is determined by adding or removing weights to the machine. Other similar types of exercise apparatus are used, such as that sold under the trademark PARAMONT®.

In view of the popularity of the exercise machines provided at health clubs, more recently a series of exercise machines has been made available for home use. However, in view of the cost and space limitations, the home exercise devices have been multi-use machines.

A typical exercise device is shown in U.S. Pat. No. 5,277,684 issued Jan. 11, 1994 to Robert W. Harris. That device is a multi-functional exercise apparatus which is adapted to work selected muscle groups against the force of elastic bands. The device is a dual lever arm machine wherein each lever arm can have its biased direction of rotation changed by retraction of a single biasing pin. The user will sit in a chair and pull or push on the lever arms.

Another device is disclosed in U.S. Pat. No. 3,876,198 issued Apr. 8, 1975 to Donald E. Seligman. That device is an inclined exercise bench with motorized bars positioned laterally above the bench so the user reclining on the bench can grasp the bars. The bar is oscillated in a generally fore and aft direction allowing a user holding it to be raised to a sitting position on the bench. The user then returns to a reclining position and the bar is again moved forward providing continuous exercise.

Another device is shown in U.S. Pat. No. 5,492,520 issued Feb. 20, 1996 to Donald Brown. This patent discloses an abdominal exercise which makes it easier for the user to do sit-ups. It is made of a one-piece skeletal frame having a pair of support rails, a pair of arcuate rocker portions, a pair of armrests and an upstanding arch-shaped portion connecting the support rails together. The user grasps the rails and rocks to a sit-up position and then rocks back. A similar type of exercise device is disclosed in U.S. Pat. No. 4,314,697 issued Feb. 9, 1992 to Brumfield et al. That device utilizes a triangular frame in place of the rocker portions and the user grips the handles to pull the user into a sitting position from a prone position.

U.S. Pat. No. 5,441,473 issued on Aug. 15, 1995 to Alan K. Safani discloses a back exercising device. The device has a seat for the user which allows leaning against a pivoting arm. The pivoting arm has a resistance device which provides resistance to backward motion so as to work the muscles in the back.

U.S. Pat. No. 5,545,114 issued Aug. 13, 1996 to Ned Gvoich discloses a muscle exercising device. The device is used by the user lying supine with the feet of the user held in place with cross members and a headrest is provided. Extending arms which can be made resistant to movement are provided adjacent to the neck of the user which the user can grip to go into a sitting position.

None of these prior art devices provide a portable exercise device for resistance type exercises of all muscles which make up the buttocks, including the gluteus maximus, gluteus minimis, gluteus medius and the piriformis muscles by both hip extension and hip abduction without undue stress on the lumbar and cervical spine.

OBJECTS OF THE INVENTION

An object of the invention is to provide an exercise device for resistance type exercises of all muscles which make up the buttocks.

Another object of the invention is to provide such an exercise device which is portable.

A further object of the invention is to provide such an exercise device which is readily adjustable to the size of the user.

A still further object of the invention is to provide such a device which is adjustable in resistance levels.

Other objects and advantages of the invention will appear from the following description.

SUMMARY OF THE INVENTION

According to the present invention, a portable exercise device is provided for resistance type exercises of all muscles which make up the buttocks, including the gluteus maximus, gluteus minimis, gluteus medius and the piriformis muscles by both hip extension and hip abduction without undue stress on the lumbar and cervical spine. The device has a generally horizontal extending base with a headrest and a lumbar back support allowing the user to lie supine on the base. The headrest and back support are affixed to the base. Two resistance bars are pivotally connected to the base to allow movement in both the lateral and vertical planes. The resistance bars press against the underside of the knee or thigh of the user and exert force against the knee or thigh.

Biasing means is provided for urging the resistance bar to a position about 90° to 120° from the horizontal, with a force which the user can overcome by moving the thigh of the user downward. A similar force is used to allow the user to move the knee laterally against the force, of about 40°, for abduction. A wheel or other type of control is provided for adjusting the tension mechanism to increase or decrease the force required to move the resistance bar. It is preferred that the resistance bar moves through an arch of about 120°. The resistance bars act separately so that one leg can remain in its normal position while the other leg is raised, and vice versa, or both legs can be raised at the same time. The headrest can be slidably connected to the frame to allow horizontal movement for adjustment to accommodate users of different heights. When the proper distance is determined, a set screw is utilized to tighten the headrest so it maintains its set position. The preferred distance is from the neck to the pivot of the hip. A typical distance between the leading edge of the headrest and the pivoting point of the resistance bars would be 16 inches. Handholds are provided so the user can maintain position and provide stabilization and counter-force or resistance.

The apparatus is preferably made of tubular aluminum of from 0.5 to 1.5 inches in diameter, but any suitable material can be used, such as boxed aluminum, steel or PVC pipe. In the preferred arrangement, the resistance bars are formed of tubular aluminum of 0.75 inches in thickness and the frame from tubular aluminum of 1.25 inches in thickness.

Various means can be used to supply the tension, such as rubber bands, springs or a hydraulic piston. Other means for applying resistance can also be used. As an example, the handholds can be interconnected with the resistance bar so the force of arm pressure can be utilized. Similarly, the resistance bar may incorporate an isotonic device providing resistance.

BRIEF DESCRIPTION OF THE DRAWINGS

The foregoing and other objects, features and advantages will be apparent from the following description of the preferred embodiment of the invention as illustrated in the accompanying drawings.

DESCRIPTION OF THE PREFERRED EMBODIMENT

Figure 1:
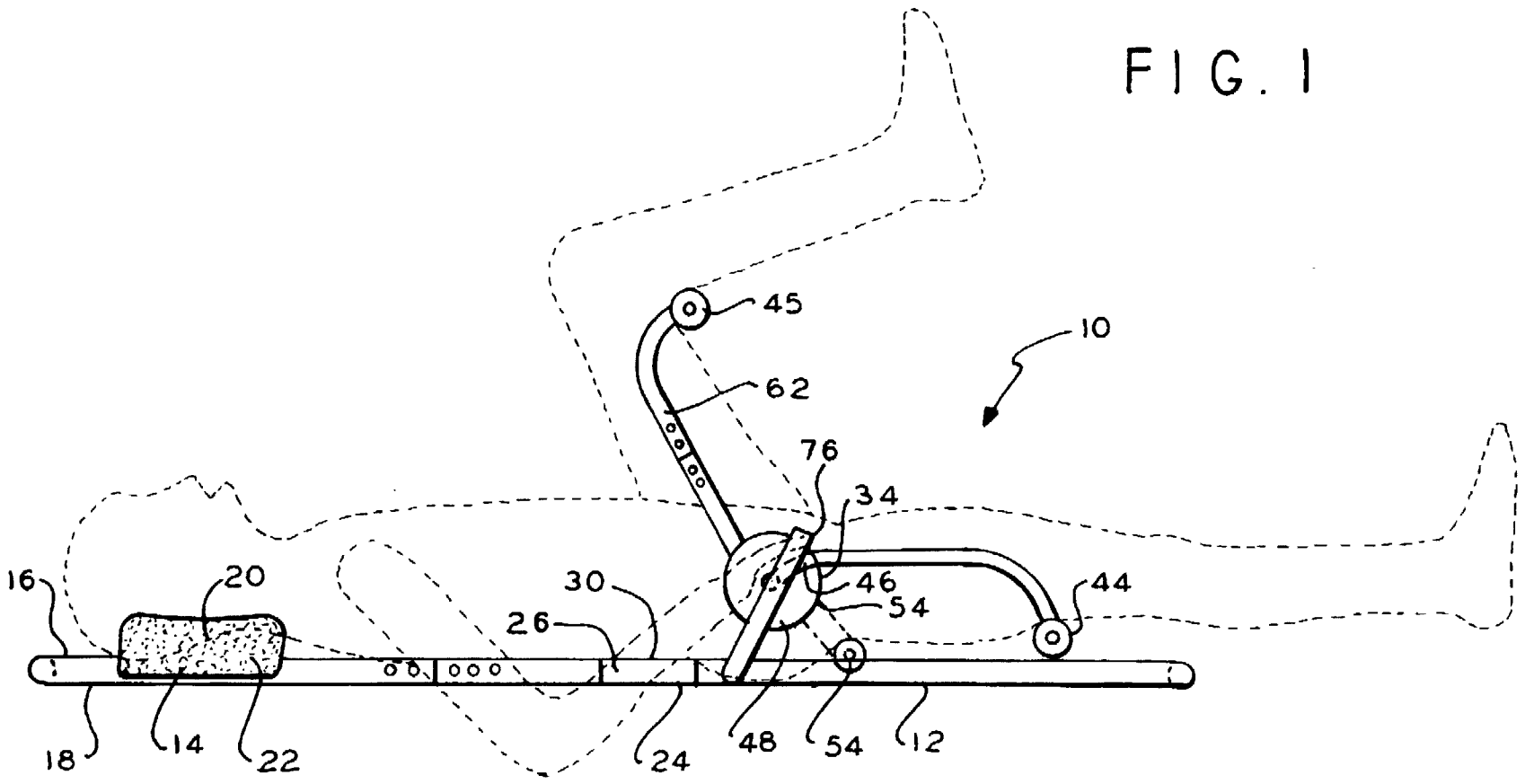
FIG. 1 represents a side view in perspective of a first embodiment of the exercise device of the invention showing a user in phantom.
Figure 2:
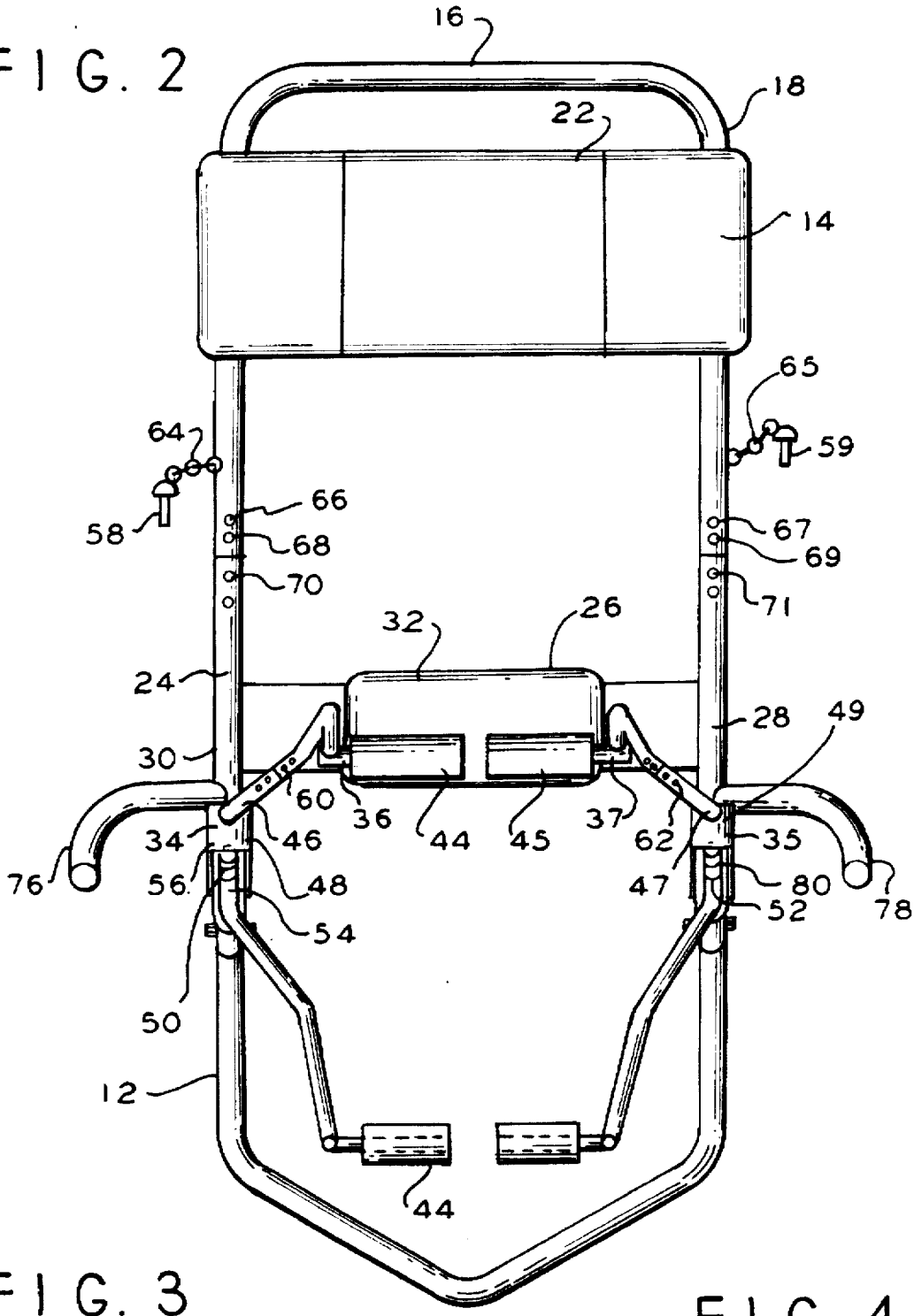
FIG. 2 is a top view in perspective of the exercise device shown in FIG. 1.
Figure 3:
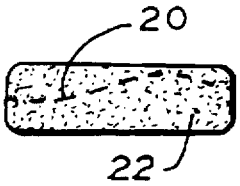
FIG. 3 is a side view of a headrest.

As shown by reference to the drawings, the exercise device of this invention generally indicated at 10, has a base 12 with a headrest 14 affixed to one end 18 of the base on the upper side 16. The headrest 14 is contoured 20 to conform to the shape of the head and neck of the user and cushioned 20 to make it more comfortable such as by constructing a portion of the headrest from foam rubber or other foamed plastic 22. At a point 24 about midway on the base a back support 26 is provided. The back support extends from one side 28 of the frame to the other side 30 and can have a padded surface 32 on the area of contact of the back of the user. Pivotally connected 34, 35 to the midpoint of the frame are two resistance bars 60, 62 of generally "L" shaped construction. The upper ends 36, 37 of the resistance bars, forming the shorter leg of the "L," are for pressing against the underside of each of the thighs of the user. The upper ends 36, 37 of the resistance bars preferably have padded units 44, 45 where they contact the thighs. The padded units 44, 45 can revolve around the upper ends 36, 37 of the resistance bar to reduce friction on the skin of the thigh of the user. The lower ends 46, 47 of the resistance bar are pivotally connected 34, 35 to the base. Biasing means 48, 49 are provided for urging the upper ends 36, 37 of the resistance bars to a vertical, upright position with a force which the user can overcome by moving the thigh of the user downward the biasing means also exerting a force to resist lateral movement of the resistance arm.

The biasing means are a conventional spring or rubber band torsion mechanism. The rubber bands 50, 52 affixed at one end 54 to the frame and at the other end 56 to the lower end 46 of the resistance bar 60. In place of the rubber bands or springs, hydraulic pistons can be utilized. A typical biasing means is disclosed in U.S. Pat. No. 5,277,684 issued Jan. 11, 1994 to Robert W. Harris which is incorporated herein by reference.

Figure 4:
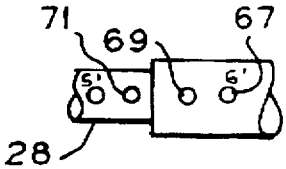
FIG. 4 is a partial cross sectional view showing the length adjusting mechanism.

The height of the resistance bar and the distance between the headrest 14 and the back support 26 is preferably made adjustable so that it can accommodate users of different dimensions. One way of making the exercise device adjustable is to construct the device of tubular aluminum with two tubes telescoped together and which can be extended to the desired length. This length adjustment means can be used for both the resistance bar and the frame. Referring to FIG. 4, the frame rails are made of two pieces which telescope together. Holes 67, 69 and 71 are provided in each section of the frame so a pin can be inserted to hold it at the selected length. Indicia can be applied next to each hole to indicate the height, or leg length, which corresponds to the particular hole. As indicated, a pin 58, 59 on a chain 64, 65 affixed to the frame can be inserted in the holes 66, 68, 70, 67, 69, 71 provided in the telescoping portions to maintain the frame in a fixed position. As indicated, if desired, height 72 and length measurement 74 can be imprinted along the holes so the user can insert the pins in the holes which best accommodate the users height and leg length.

Although using telescoping tubular frames is a convenient method of making the frame adjustable, it will be apparent to one skilled in the art that other means can be utilized, such as rectangular box frames or key ways. The exercise device can be made easier to use if gripping handles 76, 78 are affixed to each side of the frame to allow the user to pull against the handles when moving the legs of the user.

The exercise device is used by placing it on the floor. The user lies supine with the head of the user on the headrest and the lumbar back of the user on the backrest. One thigh of the user is raised and engages the resistance arm with the padded portion being back of the thigh. The user then moves the leg and thigh downward to a horizontal position multiple times until fatigued. In the next exercise the user presses against the resistance arm to move it laterally. These exercises can be done on one leg at a time or with both legs simultaneously. Again, this is done until fatigued for a proper workout.

It will be readily apparent from the foregoing description of illusive embodiments of this invention that a particularly novel and extremely effective physical exercising device is provided. This device is relatively simple to fabricate and requires a minimal effort to position on a surface for use in performance of exercise. The structure is economical to fabricate and can be made, as an example, from tubular or rectangular box steel.

While the invention has been described in its preferred embodiment, it is to be understood that the words which have been used are words of description rather than limitation and that changes may be made within the purview of the appended claims without departing from the true scope and spirit of the invention in its broader aspects.

What is claimed is:

1. An exercise device for providing resistance type exercise of all the muscles which make up the buttocks, comprising a generally horizontal extending base having a length;

a headrest affixed to the base;

a resistance bar for pressing against the thigh of the user;

means pivotally connecting the thigh bar to the base;

biasing means for urging the resistance bar to a vertical position with a force which the user can overcome by moving the thigh of the user downward the biasing means also exerting a force to resist lateral movement of the resistance bar; and a support means for supporting the back of the user affixed to the base.

2. The exercise device as defined in claim 1 including adjusting means for varying the distance between the head portion and the pivoting point of the hip.

3. The exercise device as defined in claim 1 wherein the resistance bars have a lower curved section extending inwardly from the pivoting point, and an upper section extending at a right angle, and freely rotating surfaces for contacting the back of the thighs of the user.

4. The exercise device as defined in claim 1 wherein handles are affixed to the base to allow the user to grip the handles while in use.

5. The exercise device as defined in claim 1 wherein the head portion is angled from the plane of the base to cradle the head and neck of the user.

6. The exercise device as defined in claim 5 wherein the head portion is contoured to conform to the shape of the head and neck of the user.

7. The exercise device as defined in claim 1 wherein said support means is affixed to each side of the base at a mid-portion to provide support, stabilization and counter-force of the lower extremity exercise.

8. The exercise device as defined in claim 1 wherein the biasing means includes isotonic resistance device.

9. The exercise device as defined in claim 1 wherein the biasing means includes rubber band means.

10. The exercise device as defined in claim 1 wherein the biasing means includes spring means.

11. The exercise device as defined in claim 1 wherein the biasing means includes hydraulic pistons means.

12. The exercise device as defined in claim 1 wherein the resistance bars move in an angle of 120°.

13. The exercise device as defined in claim 1 wherein the base is made of tubular aluminum formed in a generally rectangular shape.

14. An exercise device for providing type exercise of all the muscles which make up the buttocks, comprising a generally horizontal extending base in a rectangular shape formed of aluminum tubing;

a headrest affixed to the base contoured to conform to the shape of the head and neck of the user to cradle the head and neck or cervical spine of the user;

resistance bars having a padded upper section for pressing against the posterior thigh or knee of the user and a lower curved section;

means pivotally connected the lower section of the resistance bar to a midpoint of the base to allow movement of the resistance bar 90°;

biasing means for urging the resistance bar to a vertical position with a force which the user can overcome by moving the thigh of the user downward;

a padded support means for supporting the back of the user affixed to the frame;

adjusting means for varying the distance between the head portion and the pivoting point of the resistance bar and for varying the length of the resistance bar bearing markings to indicate the correct length;

biasing means for exerting a force to resist lateral movement of the resistance bars in a 40° range;

the lower section of the resistance bars being curved and extending inwardly from the pivoting point, and the upper sections of the resistance bars being padded and extending at a right angle and freely rotating surfaces for contacting the back of the thighs of the user handles affixed to the base to allow the user to grip the handles while in use.

15. A method of exercising all of the muscles which make up the buttocks, comprising providing a generally horizontal extending base having a length;

a headset affixed to the base;

a resistance bar for pressing against the thigh of the user;

means pivotally connecting the thigh bar to the base;

biasing means for urging the resistance bar to a vertical position with a force which the user can overcome by moving the thigh of the user downward the biasing means also exerting a force to resist lateral movement of the resistance arm, and a support means for supporting the back of the user affixed to the base, placing the user supine on said supporting surface, pushing successively each thigh of the user downward against a force maintained on the underside of the knee or thigh, and moving the knee laterally against a force and returning the knee to its original location to exert concentric and eccentric forces.

* * * * *